US005941330A

United States Patent [19]

Miller et al.

[11] Patent Number: 5,941,330

[45] Date of Patent: Aug. 24, 1999

[54] OPERATOR ENCLOSURE

[75] Inventors: Gordon Edward Miller, Lenoir City; David Arthur Doering, Knoxville, both of Tenn.

[73] Assignee: Deere & Company, Moline, Ill.

[21] Appl. No.: 08/954,290

[22] Filed: Oct. 17, 1997

[51] Int. Cl.[6] ..... B62D 33/067

[52] U.S. Cl. ..... 180/89.15; 180/328; 280/756; 414/680

[58] Field of Search ..... 280/756; 180/89.12, 180/89.13, 89.14, 89.15, 89.16, 89.18, 89.19, 327, 328, 330, 331, 334; 414/680, 685, 686, 914

[56] References Cited

U.S. PATENT DOCUMENTS

| | | | |
|---|---|---|---|
| D. 314,389 | 2/1991 | Lynnes et al. | D15/25 |
| 4,408,672 | 10/1983 | Albright et al. | 180/89.14 |
| 4,811,983 | 3/1989 | Watts et al. | 296/190 |
| 5,042,602 | 8/1991 | Nakatani et al. | 180/68.1 |
| 5,169,278 | 12/1992 | Hoechst et al. | 414/685 |
| 5,551,826 | 9/1996 | Todd et al. | 414/68 |

OTHER PUBLICATIONS

Deere & Company, copies of six (6) photos of Melroe Bobcat 873 Skid–Steer Loader, pp. 1–3, Published in 1997 in USA.

Deere & Company, John Deere Skid–Steer Loaders, pp. 1–10, See particularly pp. 1,5,9, Published 1995 in USA.

Melroe Company, Bobcat 853 C–Series Skid–Steer Loader, pp. 1–6, See particularly p. 2, Publish date–unknown, Published in USA.

Melroe Europe, Bobcat Kompaktlader 7753, pp. 1–6, See particularly p. 2, Published date–unknown, Publish in Europe.

FAI s.p.a., FAI Panda, pp. 1–14, See particularly p. 10, Publish date–unknown, Published in Europe.

Martimex, Martin, Czechoslovakia, Building Machines and Machines for Earthmoving and Roadmaking Works, pp. 1–12, See particularly p. 2, Publish date–unknown, Published in Europe.

Gehl, Work With a Winner, Gehl 5636 and 6635 Skid Loaders, pp. 1–12, See particularly p. 5, Published in 1996 in USA.

New Holland, New Holland Skid–Steer Loaders, L465, LX485, L565, L865, LX885, pp. 1–12, See particularly pp. 5 and 9, Published in 1995 in USA.

Takeuchi Manufacturing (U.S.) Ltd., Takeuchi TL26 Compact Track Loader, pp. 1–2, See particularly p. 2, Publish date–unknown, Published in USA.

Case France, Skid Steers 85XT, 90XT, 95XT pp. 1–8, See particularly p. 3, Published in Mar. 1997 in Belgium.

J I Case, Case Model 1818 Uni–Loader, pp. 1–4, See Particularly p. 4, Publish date–unknown, Published in USA.

J ICase, Case Model 1835C Uni–Loader, pp. 1–4, See particularly p. 3, Publish date–unknown, Published in USA.

*Primary Examiner*—Paul N. Dickson

[57] ABSTRACT

A rearwardly swinging operator enclosure is provided for a skid-steer loader having vertical lift arms. The enclosure, as well as the links coupling the lift arms to the loader are both pivotally mounted high on laterally spaced apart support posts carried at the rear of the enclosure. The raised pivotal mountings permit the enclosure to swing rearwardly and high above the loader components housed beneath the enclosure to allow maintenance activities to be conveniently carried out from the front of the loader. The raised pivotal mountings further permit the use of a cross member to reinforce both the support posts and lift arm links and yet avoid interference with swinging movement of the enclosure or lift links. With the cross member positioned near the top of the support posts, rear visibility is enhanced.

11 Claims, 8 Drawing Sheets

OPERATOR ENCLOSURE

FIELD OF THE INVENTION

The present invention relates to skid-steer loaders and more particularly to an operator enclosure which can be swingably moved between its operative position and a rearwardly raised position to permit access to loader hydraulic, electrical and drive components for maintenance purposes.

BACKGROUND OF THE INVENTION

Skid-steer loaders are small work vehicles equipped with hydraulically powered lift arms that jointly carry a bucket or other working tool at their forward ends. An operator station or enclosure is carried in the middle portion of the loader.

Beneath the operator enclosure are housed loader components such as a hydrostatic transmission, steering linkages, hydraulic lines and valves for powering the lift arms, bucket, and auxiliary functions, hydraulic lines for the wheel motor drives and miscellaneous electrical wiring harnesses and connections. To permit access to these loader components for maintenance and related services, the operator enclosure must be moved. Common methods of moving it include sliding it forward, pivotally swinging it forward, and pivotally swinging it rearwardly.

Since the lift arms of a skid-steer loader extend along its sides, they can block access to the components. Front access is therefore often preferred. When forwardly sliding or forwardly swinging operator enclosures are provided on loaders, front access is precluded and the lift arms must be raised to permit access from the sides of the loader. When the loader hydraulic power system is not operable, the arms cannot be easily raised and working access can become difficult. To overcome this problem, some skid-steer loaders have been equipped with rearwardly swinging enclosures.

It is often desirable to equip skid-steer loaders with lift arms that raise vertically so that the vertical height and forward reach of the bucket is maximized and it is easier to empty the loader bucket into a truck. When such lift arms are provided on a skid-steer loader, both the forward and rearward ends of the arms are mounted to raise vertically and move the bucket along a substantially vertical path. To facilitate vertical movement of the arms, their rear portions are pivotally connected to links that allow the rearward ends of the arms to raise vertically relative to the loader. These links are sometimes mounted on vertically raised frame structures on the loader to increase the vertical reach of the arms. Because the links also permit swinging movement of the arms, the arms can be extended forwardly when raised to improve the ability to empty a load over the sides of a dump truck.

Since the raised frame structures must support the lift arms as well as the bucket and its load, they are sometimes reinforced with one or more cross members. Further, the links which support the lift arms are often reinforced with one or more transversely extending cross members. Either or both of these cross members can provide an obstacle to swinging an operator enclosure rearwardly and can severely restrict the degree to which it can swing upwardly and rearwardly. Accordingly, the available working area beneath the rearwardly raised operator enclosure, wherein maintenance on the vehicle components can be performed, can be restricted.

It would therefore be desirable to provide a skid-steer loader having an operator enclosure which can be moved upwardly and rearwardly to access the working components from the front of the vehicle. It would also be desirable to provide such an operator enclosure on a loader having links between the loader and rear end portions of the lift arms to provide vertically lifting arms.

It would further be desirable to provide support posts for mounting the lift arm links to enable the arms to raise above the loader frame and maximize their vertical height and forward reach for dumping loads over the sides of a dump truck.

Also, it would be desirable to provide a reinforcing cross member to stabilize the links and posts as well as permit the use of less substantial support structures for the posts.

It would further be desirable to mount the operator enclosure such that the bottom and back portions of the enclosure raise up and above the access or working area, and are not restricted in their upwardly and rearwardly movement by the cross member.

It would also be desirable to minimize the bulk of the operator enclosure, particularly the size of the frame components required in its construction.

And it would be desirable to provide a power means for raising the operator enclosure that will function when the loader's hydraulic or electrical power systems is down as well as one which is releasably lockable to secure the enclosure in its raised position.

SUMMARY OF THE INVENTION

Accordingly, there is provided a skid-steer loader with vertically lifting arms and an operator enclosure that can be swung upwardly and rearwardly even when the loader experiences a complete hydraulic and electrical power failure.

The rear of the operator enclosure is pivotally connected to the top portions of upstanding support posts, providing high pivot points for upwardly swinging movement of the enclosure and the posts serve as structural frame members for the enclosure during operation. The pivot structures for the operator enclosure are located at its upper rear portion to permit the bottom and back sections of the enclosure to be lifted substantially above the loader components and provide a sufficient work area for service. The links which provide vertical lift capability to the lift arms are also pivotally mounted on the support posts to maximize their vertical lift and forward reach and simplify the design. A reinforcing cross member is provided between the posts and connecting ends of the lift links to stabilize the posts and links and minimize the post size required.

The pivot structures for the enclosure are located adjacent to and slightly forward of the cross member to eliminate interference between the enclosure and cross member when the enclosure is swung upwardly and rearwardly for access to the vehicle components. The cross member and pivot structures for both the enclosure and lift links are located near the top of the support posts to improve rear window visibility. Gas cylinders are provided to assist in raising the enclosure and include releasable locking mechanisms so that it can be safely secured in a raised position.

DESCRIPTION OF THE PREFERRED EMBODIMENT

Figure 1:
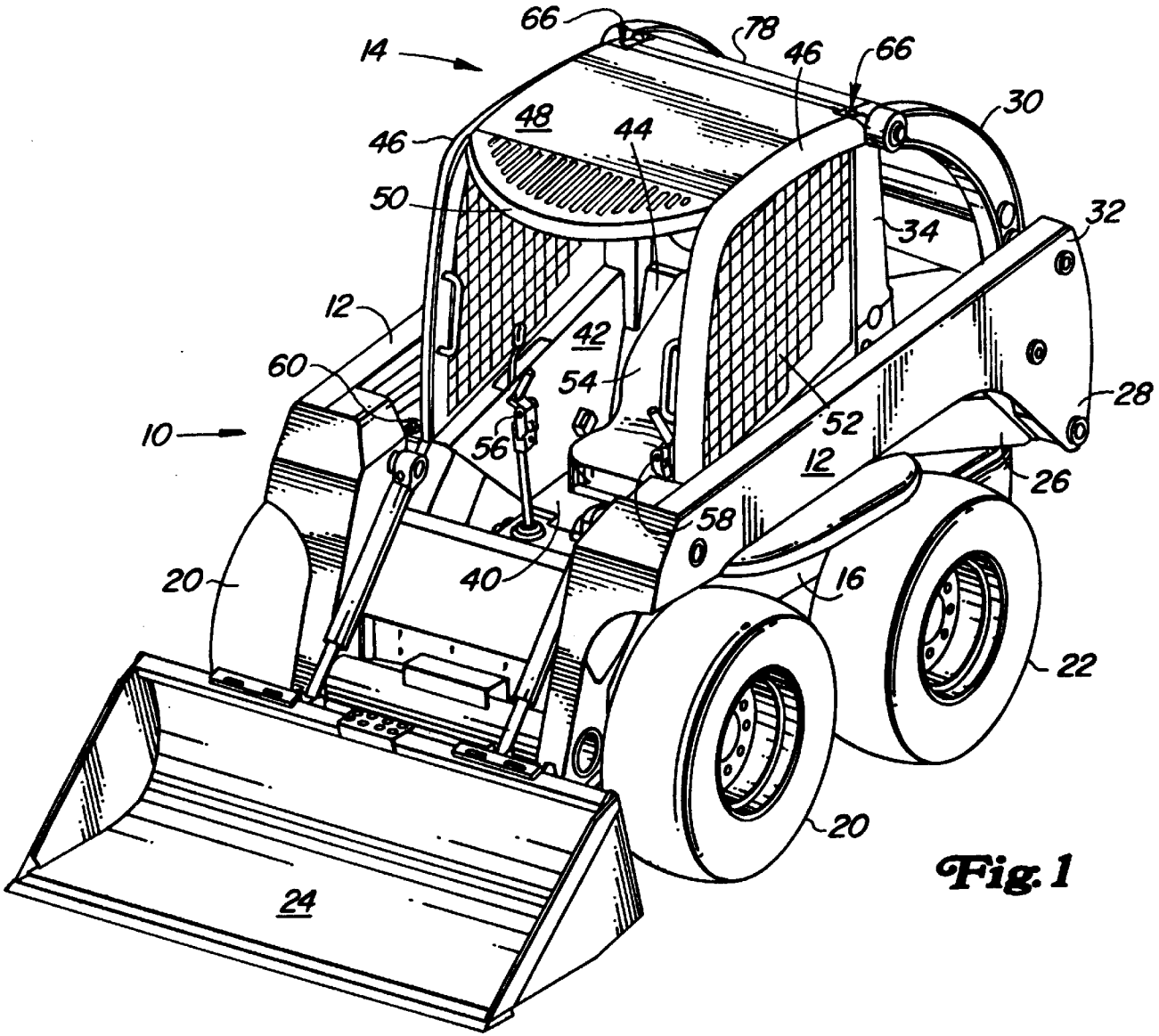
FIG. 1 is an elevated front right perspective view of a skid-steer loader with a swinging operator enclosure in its operative position.
Figure 2:
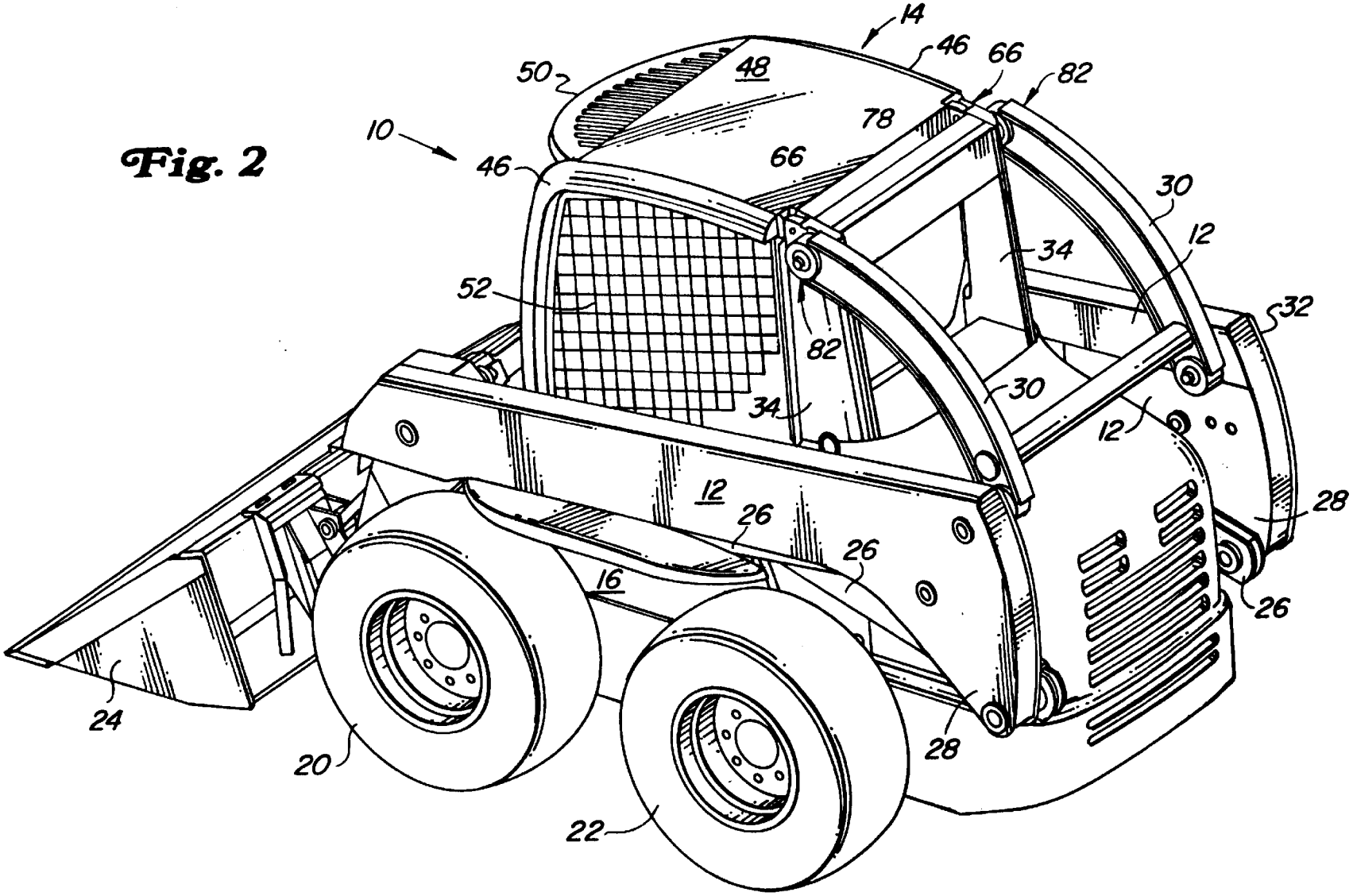
FIG. 2 is an elevated rear left perspective view of a skid-steer loader with the enclosure in its operative position.

Looking first to FIGS. 1 and 2, there is illustrated a skid-steer loader 10 having vertically lifting arms 12 and a rearwardly swinging operator enclosure 14. The loader frame 16 supports a rear mounted engine 18 and front and rear wheels 20 and 22. As is common in skid-steer loaders, the rear wheels 22 are independently driven and coupled with their respective front wheels 20 by chain drives (unshown). The enclosure 14 is carried in the central portion of the frame 16, between the lift arms 12.

The lift arms 12 are adapted to support a bucket or similar working tool 24 at their forward ends and are mounted on the frame 16 to raise vertically. To enable such movement, each arm 12 is pivotally connected to a first link member 26 which extends between the frame 16 and a lower rear portion 28 of the arm 12. Second or upper link members 30, comprised of arc-shaped structures, are pivotally connected between the top rear portion 32 of each arm 12 and one of the upstanding left and right posts 34 carried at the rear portion of the loader frame 16. Hydraulic cylinders 36 are provided between the frame 16 and each arm 12 for raising and lowering it.

Figure 10:
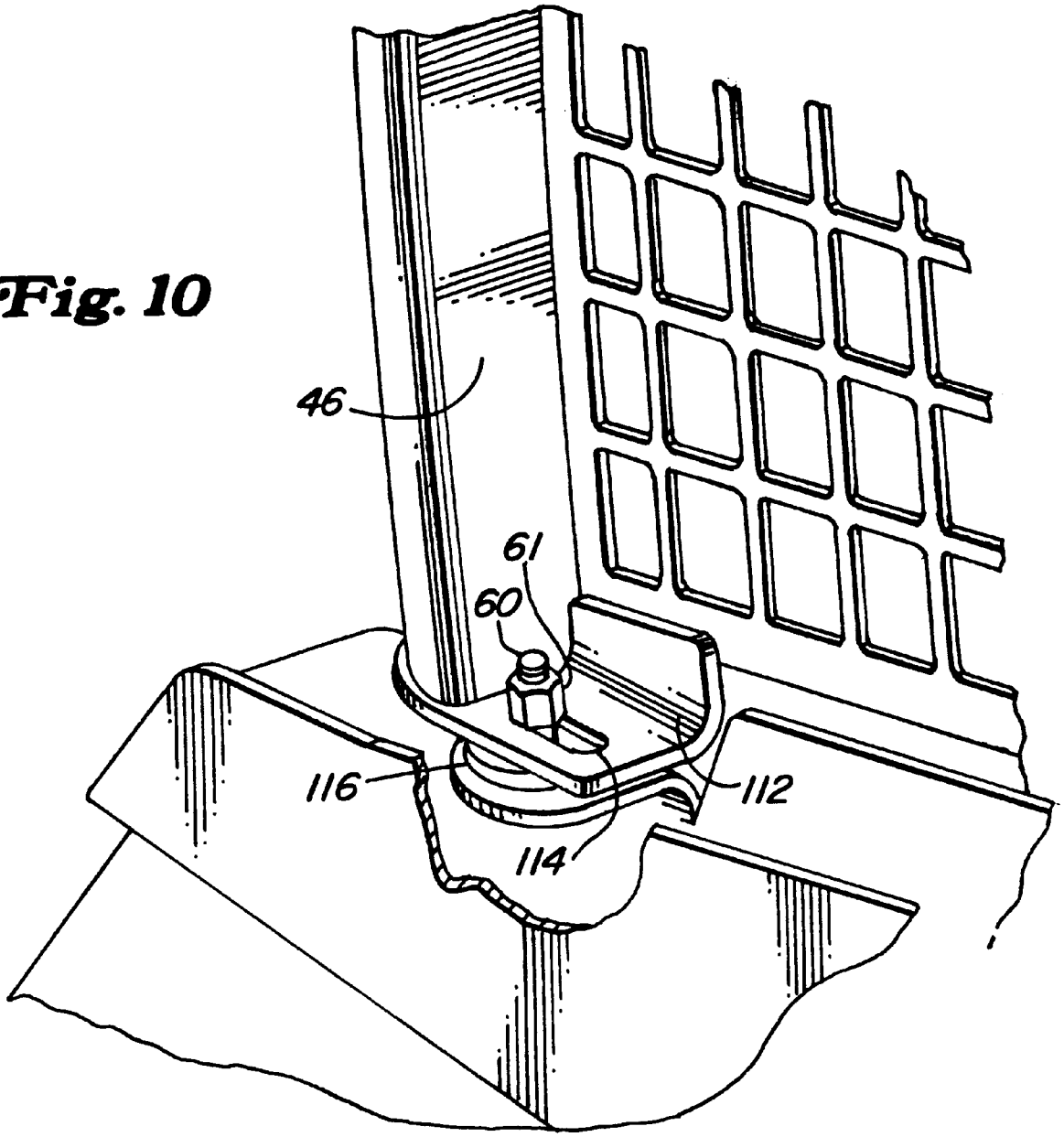
FIG. 10 is an enlarged and elevated rear perspective view of the fastening structure used to secure the operator enclosure to the loader frame during operation.

The operator enclosure 14, which is best shown in FIGS. 1, 2, 3 and 4, includes a base 38 having a floor 40 with integral side and rear walls 42, 44, tubular side members 46 extending from the side walls 42 and to the post supports 34, a roof 48 with a forwardly extending tubular frame 50 and protective wire sides 52. The upstanding posts 34 at the rear of the loader 10 provide additional rollover protective support structure for the enclosure 14. The enclosure 14 further includes a seat 54 mounted on the base 38 and miscellaneous gauges mounted within it. Left and right wheel control levers 56 and 58 project upwardly from the frame 16 at the forward edge of the enclosure 14. Fasteners, taking the form of bolts 60 and nuts 61, secure each side of the enclosure 14 to the frame 16 and retain it in its operative position, see FIGS. 3 and 10.

Figure 3:
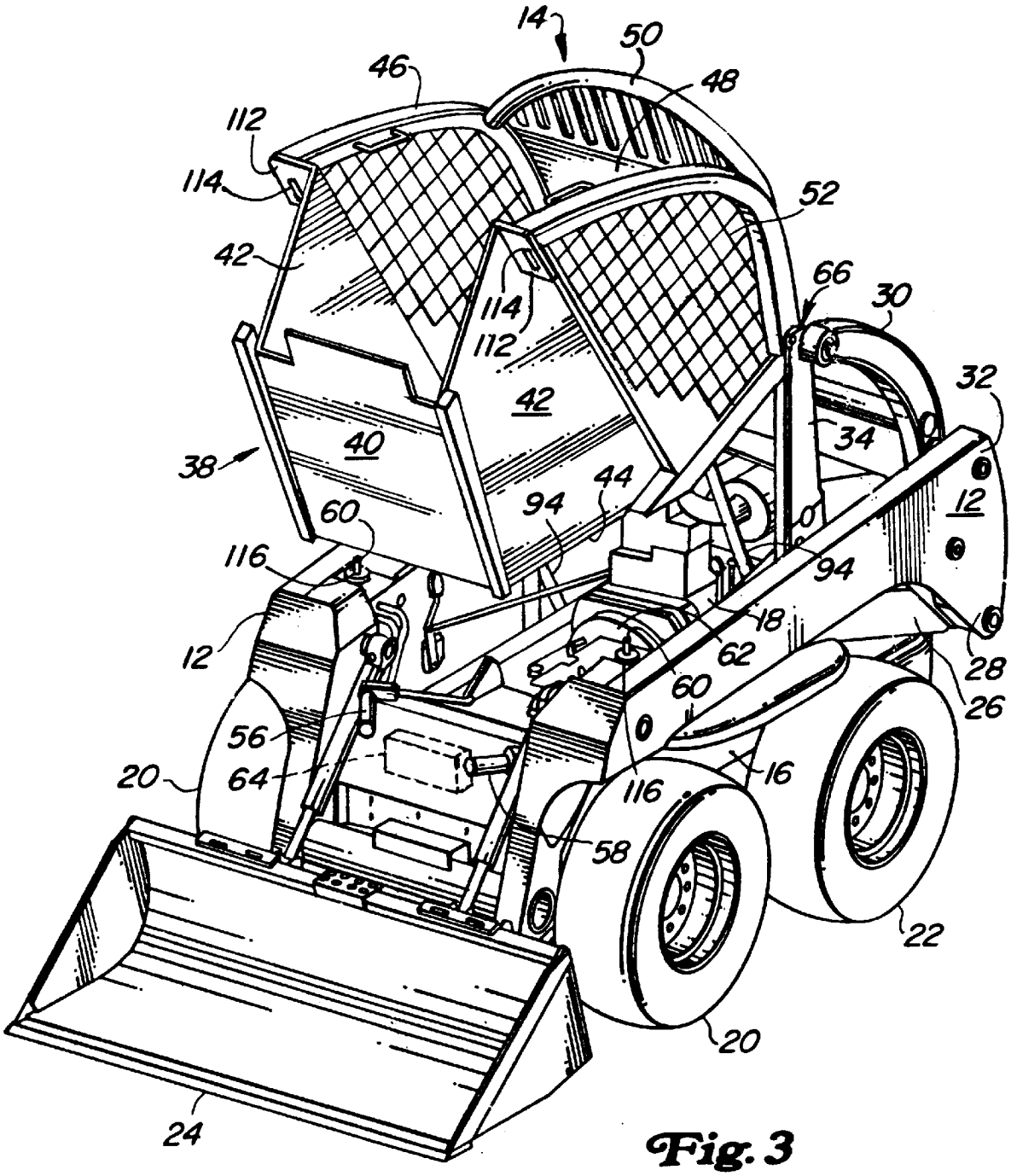
FIG. 3 is an elevated front right perspective view of the loader with the enclosure in its raised position.
Figure 4:
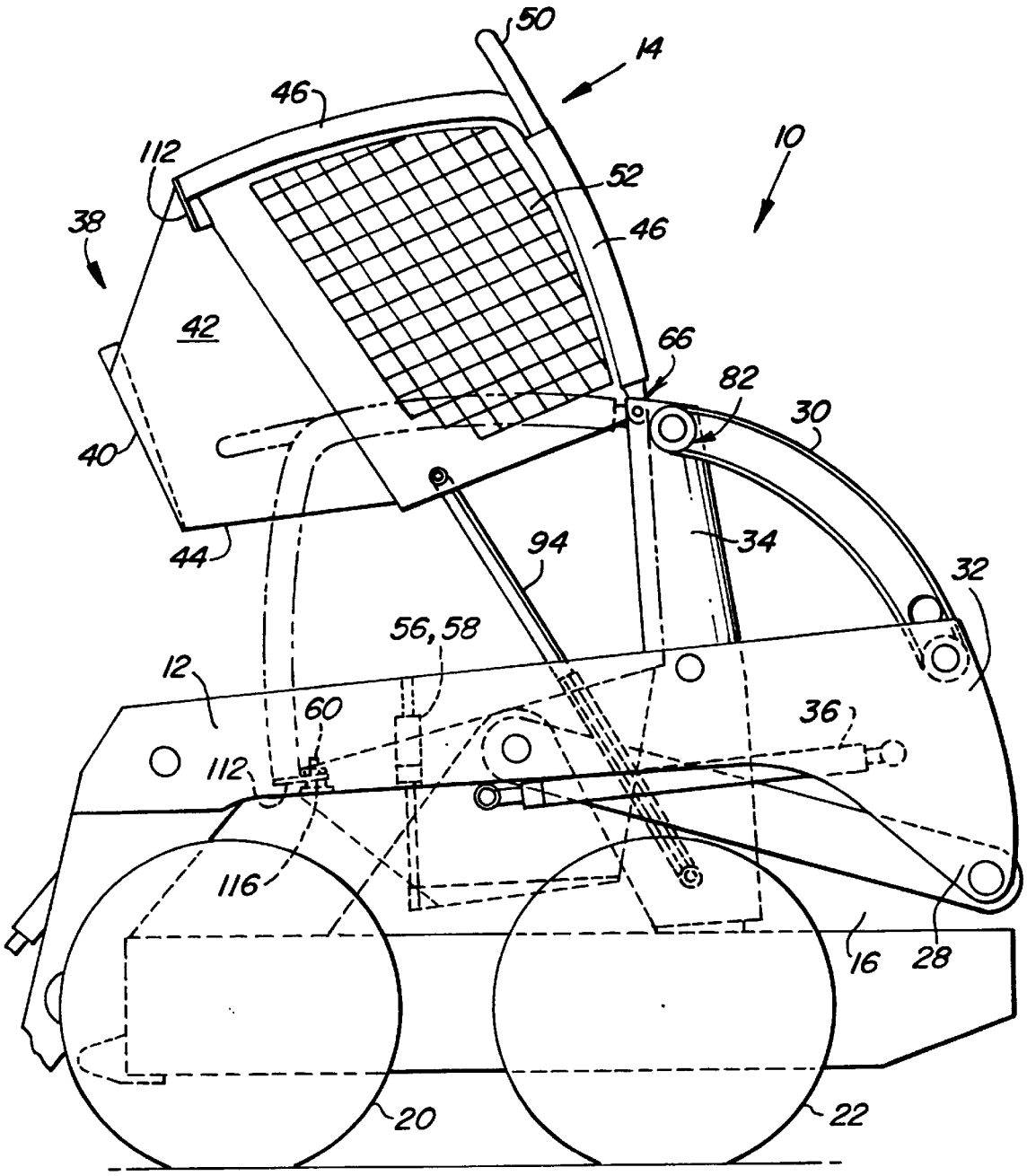
FIG. 4 is a schematic side view of a loader with its enclosure in its raised position and illustrating in phantom the enclosure in its operative position

In FIGS. 3, and 4, the loader 10 is shown with the enclosure 14 in its upwardly and rearwardly raised position, providing access to the various loader components housed beneath it. They include the hydrostatic transmission 62, steering linkages that interconnect the control levers 56 and the hydrostatic transmission 62, hydraulic valves 64 and attached lines for powering the lift arms 12, bucket 24 and auxiliary loader functions, hydraulic lines for the wheel motor drives and miscellaneous electrical wiring harnesses and connectors.

Figures 5, 6:
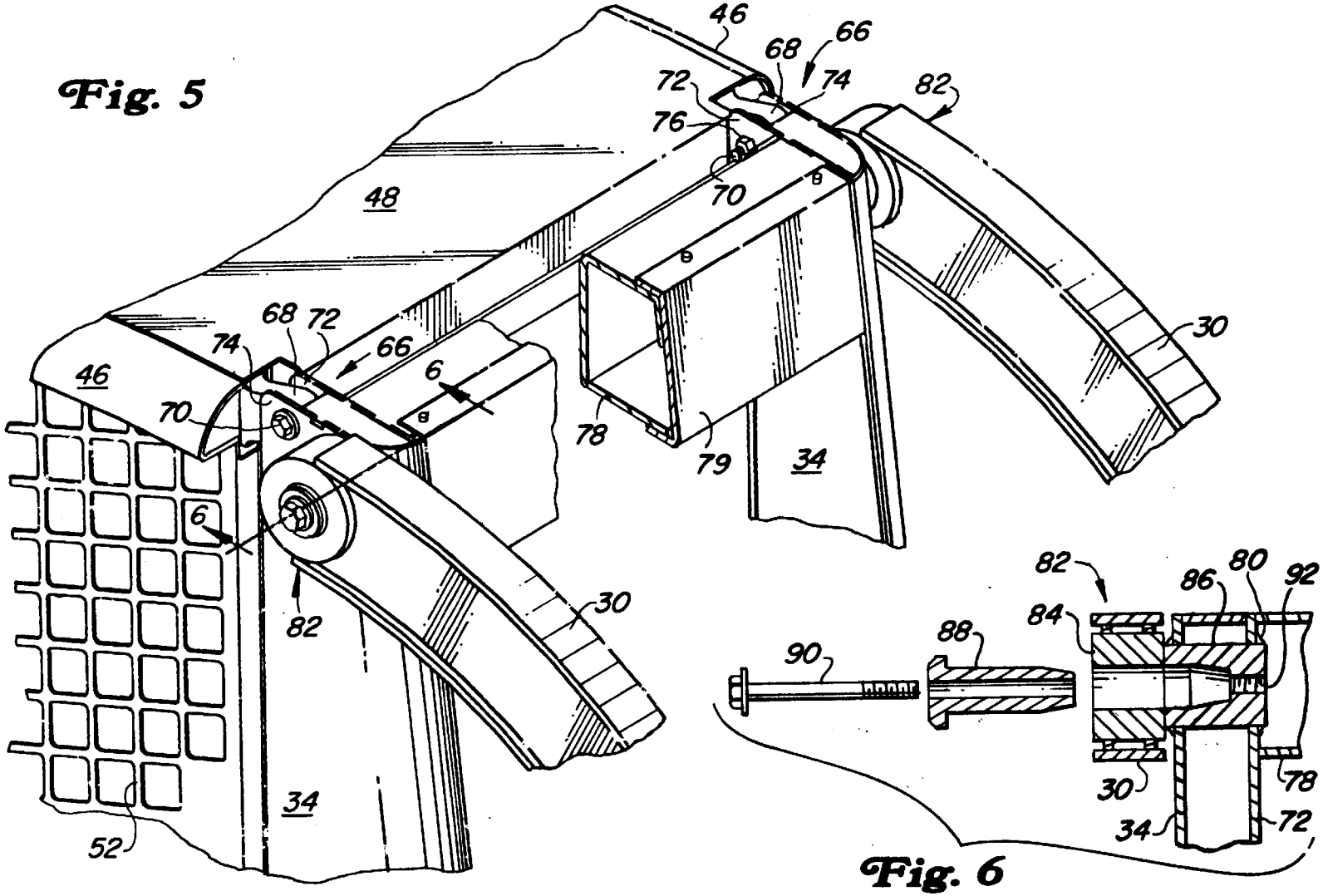
FIG. 5 is an enlarged and elevated rear left perspective view of the pivot structures which swingably support the enclosure and upper link members with the loader posts.
FIG. 6 is a view taken along lines 6—6 of FIG. 5.

As shown in FIGS. 3, 4, and 5, the enclosure 14 is mounted to swing upwardly and rearwardly about left and right pivot structures 66 carried at the top ends of the posts 34. Each pivot structure 66 includes an ear 68 attached to and extending from one of the tubular side members 46. Bolts 70 are used to secure the ears 68 between the inner and outer walls 72 and 74 of the respective posts 34. Each bolt 70 is provided with threads at one end and nuts 76 are used to lock the bolts 70 to the inside and outside walls 72 and 74 of the posts 34.

Extending between the upper ends of the posts 34 and just behind the pivot structures 66 is a reinforcing cross member 78, see FIG. 5, which in the preferred embodiment takes the form of a C-shaped member with cap 79 fastened thereto. The opposite ends of the cross member 78 abut and are welded at 80 to the inner walls 72 of the posts 34, see FIG. 6. The cross member 80 not only reinforces the posts 34, but stabilizes the upper ends of the links 30, thereby eliminating the need for a cross member between the upper ends of the links 30.

Pivotal interconnections 82 swingably secure the upper links 30 with the posts 34. As is best illustrated in FIGS. 5 and 6, these interconnections 82 are comprised of first bosses 84 attached to the ends of the upper links 30, second bosses 86 secured to the posts 34, tapered link pins 88 receivable through bosses 84 and seated within the second bosses 86, and bolts 90 used to secure the tapered link pins 88 within the second bosses 86. The bolts 90 are threaded and received in internal threads 92 provided within the bore of each second boss 86 to swingably mount the upper links 30 to the posts 34.

With the cross member 78, pivot structures 66 and pivotal interconnections 82 all provided near the top of the posts 34, a large rear window is provided for the enclosure 14, thereby improving rearward visibility.

In operation the loader 10 would be utilized as would similar loaders equipped with vertically lifting arms 12, that is, to enable material to be lifted high and emptied over the side of a truck for disposal. Should the loader 10 encounter mechanical problems or need maintenance requiring access to the vehicle components housed beneath the operator enclosure 14, the operator can easily swing the enclosure 14 upwardly and rearwardly to the position illustrated in FIG. 3.

Figure 7:
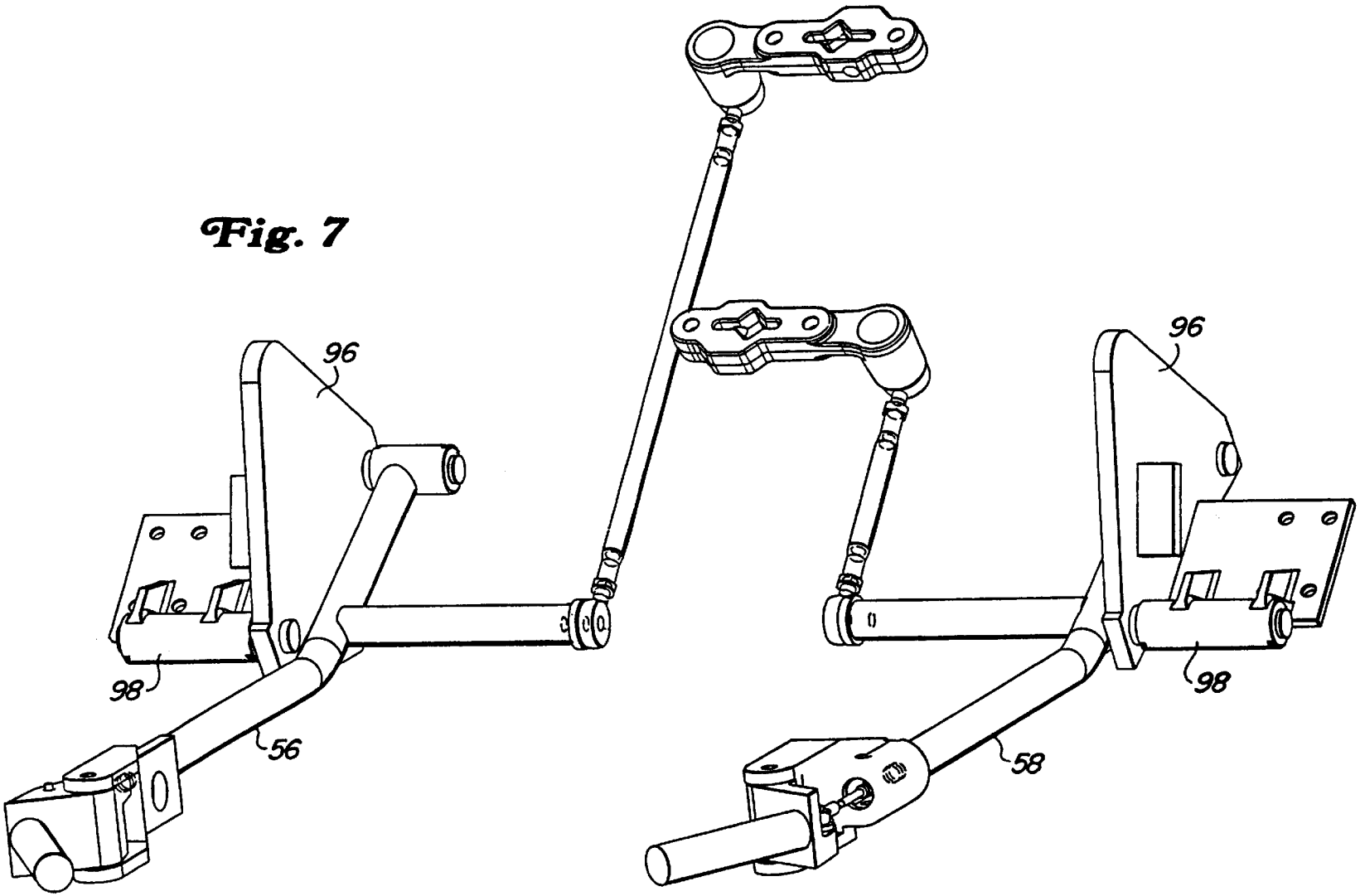
FIG. 7 is an enlarged schematic perspective view of the control handles and their cam activated support linkages.
Figure 9:
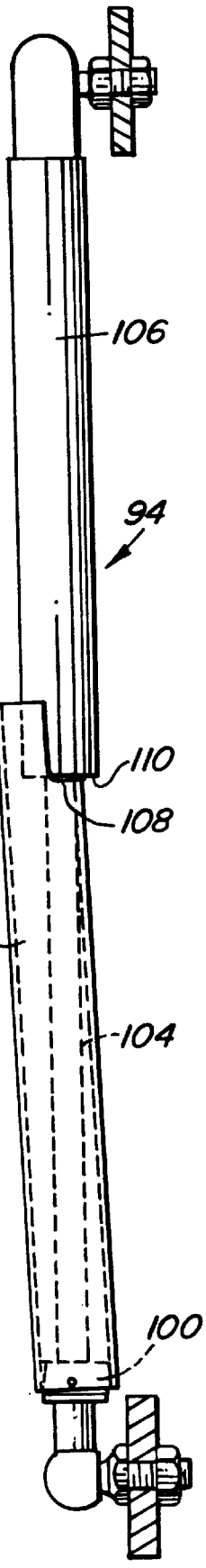
FIG. 9 is a schematic side view of the gas cylinder in its extended and locked state.
Figure 8:
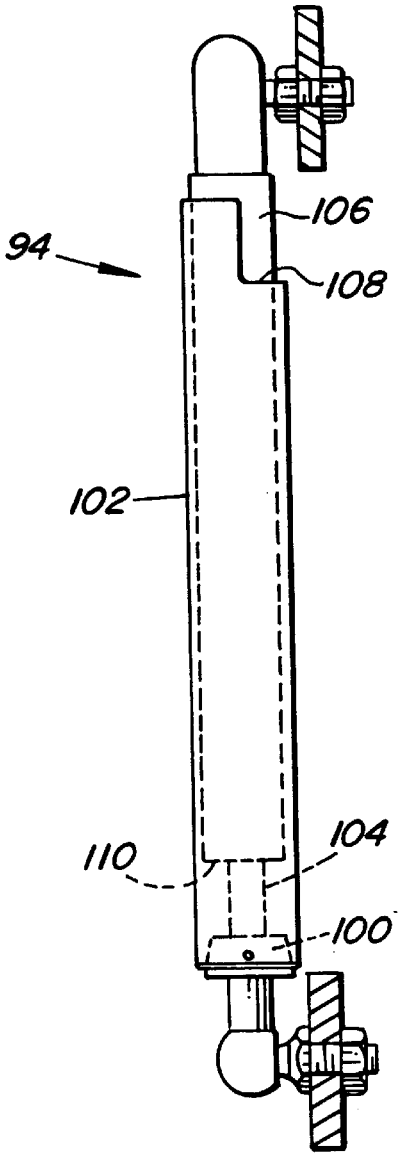
FIG. 8 is a schematic side view of the gas cylinder in its compressed state.

To swing the enclosure 14 upwardly, the operator would dismount the loader 10 and remove the nuts 61 from bolts 60, which fastened to the loader frame 16. Then standing in front of the loader 10, he would lift on the side walls 42 of the enclosure 14. As he lifted, gas cylinders 94 provided at each side of the enclosure 14 would begin to extend and assist in raising the enclosure upwardly and rearwardly about its pivotal structures 66 carried on the posts 34. As the enclosure 14 raises, the control levers 56 shift forwardly to provide clearance for the swinging enclosure floor 40 (See FIGS. 3 and 7). Shifting movement of the control levers 56, 58 is effected through interaction between the bottom surface of the floor 40 and the cams 96 carried on control lever pivot shafts 98. This feature is the subject of a related U.S. patent application Ser. No. 08/953,560, filed on Oct. 17, 1997, and its disclosure, particularly pages 2–5, is hereby incorporated by reference and made a part of this disclosure. When the enclosure 14 has been raised to its uppermost position, as illustrated in FIG. 3, a locking means carried on one gas cylinder 94 is actuated to support the enclosure 14 in the raised position. The locking means, which is best shown in FIGS. 8 and 9, is provided within one of the gas cylinders 94. It includes a seat 100 mounted in the bottom of the lower sleeve 102 which carries the cylinder rod 104 at an angle relative to the lower sleeve 102. As the cylinder 94 extends from the position illustrated in FIG. 8 to the position shown in FIG. 9, the seat 100 urges the lower sleeve 102 out of alignment with the upper sleeve 106. When the cylinder 94 is fully extended, the lower sleeve 102 shifts to the position illustrated in FIG. 9, whereby its top edge 108 slides beneath the lower edge 110 of the upper sleeve 106. With the cylinder sleeves 102 and 106 misaligned and their respective end surfaces 108 and 110 in abutment, as shown in FIG. 9, the cylinder 94 cannot retract and is "locked" in place, retaining the enclosure 14 in its raised position. One locking cylinder found acceptable for this use is the model ECV4SC500555S4D from Camloc (UK) Ltd., Fairchild Fastener Group.

With the enclosure 14 raised, access to the loader components housed beneath the enclosure 14 is easily gained from the front of the loader 10. Additional access would also be possible from the sides of the loader 10 if there has not been an electrical and/or hydraulic failure that would prevent the lift arms from being raised.

After the maintenance or repairs have been completed, the enclosure 14 can easily be returned to the operative position and secured in place. To return it to an operative position, the cylinder locking means would be disengaged to allow the cylinders 94 to retract. This is accomplished by urging the cylinder sleeve 102 with the locking mechanism inwardly, against the bias of the seat 100, to align the upper and lower sleeves 106 and 102. Once aligned, the enclosure 14 is urged downwardly to compress the cylinders 94. As the enclosure 14 swings downwardly about its pivotal connections 66 with the posts 34, the floor 40 comes into contact with the cams 96, swinging the control levers 56, 58 into the upright position illustrated in FIG. 1. At the same time, the L-shaped brackets 112 secured to the frames 46 of the enclosure 14 swing down, permitting the openings 114 to be positioned around their respective bolts 60. The nuts 61 can then be placed on the bolts 60 to secure the enclosure 14 with the loader frame 16, thereby preventing upward movement of the enclosure 14 during operation. Resilient pads 116, provided around the bolts 60, serve to cushion relative movement between the enclosure 14 and frame 16.

With the upperward and rearwardly swinging operator enclosure, access to the components from the front of the loader vehicle is easily facilitated. This advantage can be desirable particularly when the loader has encountered a complete electrical and hydraulic failure which would prevent the lift arms from being easily raised or moved so that access from the sides of the loader could be performed.

Through locating the pivotal structures for the enclosure and lift arms high and on common support posts, the lift arms are able to reach vertically and forwardly to dump loads over the side of trucks for disposal, the enclosure can be raised substantially above the loader components, rear visibility is improved and fewer and less substantial structural components are required in constructing the loader.

We claim:

1. A loader having a frame structure with laterally spaced apart sides and a fore and aft extending lift arm carried adjacent to each side of the frame structure, each lift arm having a rear end section;

a pair of laterally spaced apart and upwardly extending post members carried on the frame structure, inwardly spaced of the lift arms, said post members including upper portions;

link members pivotally interconnecting the rear end sections of the lift arms with the upper portions of the post members; and an operator enclosure carried forwardly of and between the post members, said enclosure being pivotally connected to the post members at pivot structures carried on the upper portions of said post members for swinging movement between a first operative position and a second upwardly and rearwardly raised position.

2. The invention defined in claim 1 wherein a cross member extends between the upper portions of the two post members and the pivotal structures are located adjacent the cross member.

3. The invention defined in claim 1 wherein the operator enclosure is adapted to swing upwardly and rearwardly between the post members and above the cross member.

4. The invention defined in claim 1 wherein the post members serve as rear structural supports for the operator enclosure when it is in its first position.

5. The invention defined in claim 1 wherein the operator enclosure includes a generally vertically extending rear wall and the pivotal connection is located at an upper corner of the rear wall.

6. The invention defined in claim 1 wherein the operator enclosure is assisted in swinging movement about its pivotal connection with the post members by a pair of laterally spaced apart gas cylinders extending between the frame and enclosure, one of the cylinders including a releasable locking means for securing said one cylinder in an extended position.

7. The invention defined in claim 1 wherein the enclosure includes adjoining rear and upper portions and the pivotal connection is coupled with said adjoining portions.

8. The invention defined in claim 7 wherein the pivotal interconnections for the link members are located near a top of each post member.

9. A loader having a frame structure with laterally spaced apart sides and a fore and aft extending lift arm carried adjacent to each side of the frame structure, each lift arm having a rear end section;

a pair of laterally spaced apart and upwardly extending post members carried on a mid-portion of the frame structure and inwardly spaced of the lift arms, said post members including upper portions having pivot structures;

a cross member extending between the post members adjacent to the pivot structures;

link members pivotally interconnecting the rear end section of each lift arm with the upper portion of a respective post member; and an operator enclosure carried forwardly of and between the post members, said enclosure including adjoining top and rear walls which are connected to the pivot structures for swinging movement between a first lowered position and a second upwardly and rearwardly raised position.

10. The invention defined in claim 9 wherein the link members are pivotally connected to the posts closely adjacent the pivot structures.

11. The invention defined in claim 9 wherein the pivot structures, cross member and pivotal interconnections are all mounted at top portions of the posts.

* * * * *